US006599345B2

(12) United States Patent
Wang et al.

(10) Patent No.: US 6,599,345 B2
(45) Date of Patent: Jul. 29, 2003

(54) POWDER METAL VALVE GUIDE

(75) Inventors: Yushu Wang, Marshall, MI (US); Sundaram L. Narasimhan, Marshall, MI (US); Heron A. Rodrigues, Charlotte, NC (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/969,716

(22) Filed: Oct. 2, 2001

(65) Prior Publication Data

US 2003/0061905 A1 Apr. 3, 2003

(51) Int. Cl.[7] ..... C22C 33/02

(52) U.S. Cl. ..... 75/231; 75/243; 75/246; 75/252; 75/253

(58) Field of Search ..... 75/252, 253, 231, 75/243, 246

(56) References Cited

U.S. PATENT DOCUMENTS

| | | | | | |
|---|---|---|---|---|---|
| 2,065,049 | A | | 12/1936 | Bullock | 123/188 |
| 2,070,102 | A | | 2/1937 | Weslake | 123/188 |
| 3,856,478 | A | | 12/1974 | Iwata et al. | 39/182 |
| 4,348,232 | A | | 9/1982 | Hiraoka et al. | 75/238 |
| 4,363,662 | A | | 12/1982 | Takahashi et al | 75/243 |
| 4,588,441 | A | * | 5/1986 | Ikenoue et al. | 419/11 |
| 4,648,903 | A | | 3/1987 | Ikenoue et al. | 75/230 |
| 4,702,771 | A | * | 10/1987 | Takagi et al. | 75/237 |
| 4,836,848 | A | | 6/1989 | Mayama et al. | 75/231 |
| 5,007,956 | A | * | 4/1991 | Fujita et al. | 75/238 |
| 5,041,158 | A | * | 8/1991 | Larson | 419/10 |
| 5,041,168 | A | | 8/1991 | Purnell et al. | 148/13.32 |
| 5,051,232 | A | | 9/1991 | Summers | 419/27 |
| 5,062,908 | A | | 11/1991 | Purnell et al. | 148/232 |
| 5,064,610 | A | | 11/1991 | Sato et al. | 420/57 |
| 5,154,881 | A | | 10/1992 | Rutz et al. | 419/37 |
| 5,217,683 | A | | 6/1993 | Causton | 419/38 |
| 5,271,823 | A | | 12/1993 | Schachameyer et al. | 205/224 |
| 5,286,311 | A | | 2/1994 | Purnell et al. | 75/231 |
| 5,312,475 | A | | 5/1994 | Schuler et al. | 148/328 |
| 5,326,526 | A | | 7/1994 | Ikenoue et al. | 419/38 |
| 5,406,917 | A | | 4/1995 | Rao et al. | 123/188.9 |
| 5,468,310 | A | | 11/1995 | Fujiki et al. | 148/135 |
| 5,534,220 | A | * | 7/1996 | Purnell et al. | 419/10 |
| 5,655,493 | A | | 8/1997 | Enright et al. | 123/188.3 |
| 5,824,922 | A | | 10/1998 | Aonuma et al. | 75/236 |
| 5,934,238 | A | | 8/1999 | Wang et al. | 123/188.3 |
| 5,960,760 | A | | 10/1999 | Wang et al. | 123/188.3 |
| 6,096,142 | A | | 8/2000 | Kano et al. | 148/436 |
| 6,139,598 | A | | 10/2000 | Narasimhan et al. | 75/246 |
| 6,200,688 | B1 | | 3/2001 | Liang et al. | 428/544 |
| 6,214,080 | B1 | | 4/2001 | Narasimhan et al. | 75/255 |

FOREIGN PATENT DOCUMENTS

| | | | |
|---|---|---|---|
| EP | 0 481 763 A1 | 10/1991 | C22C/32/00 |
| EP | 0 621 347 A1 | 4/1994 | C22C/33/02 |
| JP | 06346180 | 12/1994 | C22C/33/02 |

OTHER PUBLICATIONS

Wear, The Effect of Operating Conditions on Heavy Duty Engine Valve Seat Wear. (1996).

Valve Gear Wear and Materials, S. L. Narasimhan and J. M. Larson (1985).

Sintered Valve Seat Inserts and Valve Guides: Factors Affecting Design, Performance & Machinability, H. Rodrigues (1997).

* cited by examiner

*Primary Examiner*—Ngoclan Mai

(74) *Attorney, Agent, or Firm*—Daniel S. Kalka; L. J. Kasper

(57) ABSTRACT

A powder metal blend for making a powder metal part especially a valve guide 14 for an internal combustion engine particularly suited for operation where there is little or no engine oil lubricant at the valve stem 30 and valve guide 14 interface. The powder metal blend having a chemical composition on a weight percent basis of about 2 to about 10 percent copper; about 0.5 to about 5.0 percent solid lubricant; about 1.0 to about 3.0 percent graphite; about 1.0 to about 8.0 percent bronze; about 0.2 to about 1.5 percent copper-and/or iron phosphorus; about 0.3 to about 1.0 percent fugitive lubricant; and the balance being a low alloy steel powder containing about 0.3 to about 1.0 percent manganese.

19 Claims, 3 Drawing Sheets

POWDER METAL VALVE GUIDE

BACKGROUND OF THE INVENTION

1. Field of the Invention

The present invention relates in general to powder metal blends, and more particularly to a new and improved powder metal blend useful for making an improved engine component such as a valve guide.

2. Description of the Related Art

Recent concerns about the environment have created a renewed interest in the development of the so-called "zero emission engine". Ideally, this is an internal combustion engine that does not emit or discharge any pollutants. One source of and a contributing factor to air pollution in an internal combustion engine is the engine lubricant oil which can leak into the combustion chamber from a worn valve stem and valve guide interface. This is the location where the valve is reciprocatingly engaged within the valve guide. Besides being a pollutant itself upon combustion, the leaking lubricant oil containing any sulfur can damage the catalytic converter due to catalyst poisoning and can lead to further air pollution in the form of nitrogen oxides.

The operation cycle of an internal combustion engine is well known in this art. The physical requirements for the intake and exhaust valves, valve guides, and valve seat inserts to effectively interact in sealing the combustion chamber has been studied extensively. It is known that valve seat inserts and valve guides operate under a very harsh environment in terms of mechanical, thermal, and corrosive conditions with the severity depending upon the specific engine application.

In an internal combustion engine, the engine oil is allowed to controllably leak through the valve stem seal to the valve guide for providing lubrication at the valve guide interface. A leakage problem arises with wear and occasionally simply from the operating clearances necessary to accommodate differential heating between the valve stem and the valve guide. Without sufficient operating clearances, the valve stem can overheat and seize or stick within the valve guide.

Meanwhile, consumers still expect more performance from their vehicle's engines as well as longer and better warranties on the powertrain of a vehicle. As a result, many manufacturers are extending powertrain warranties at least up to 100,000 miles. The automotive industry is constantly seeking improved fuel economy, increased horsepower to weight ratios, lower oil consumption, and better reliability for its automotive engines.

Recent improvements in powder metallurgy have been employed to address requirements for good wear resistance as well as good heat and corrosion resistance along with suitable machinability. Powder metallurgy (P/M) permits latitude in selecting a wide variety of alloy systems as well as offering design flexibility. Additionally, powder metallurgy provides controlled porosity for self-lubrication and facilitates the manufacture of complex or unique shapes at or very close to final dimensions.

P/M valve guides are typically made from relatively low alloy steels containing a ferritic/pearlitic microstructure with solid lubricants such as silicates, free graphite, manganese sulfide, copper sulfide, or molybdenum disulfide. The P/M valve guide is pressed to a low to medium density, sintered using conventional sintering temperatures, i.e., less than about 1150° C., and then machined at both ends. An inner bore is formed by reaming. While it is known in this art to oil impregnate valve guides, the impregnated oil is replenished during the operation of the engine. The life expectancy of the valve guides relies on engine oil which lubricates the interface between the valve stem and the valve guide.

The oil leakage problem described previously has heretofore been addressed by attempts to control oil leakage through the valve stem seal by providing a better seal and/or attempts to achieve a compromise between lubricating the valve guide to provide a suitable life expectancy thereof and the undesirable emissions produced from the combustion of the oil into the exhaust system.

There still exists a need for a powder metal blend or mixture for use as a valve guide which can withstand the significantly high temperatures to which the valve stem and valve guide are exposed with little or no lubrication. The powder metal blend must have good thermal conductivity to allow the valve guide to conduct heat away from the valve stem to the surrounding cylinder head to prevent seizure or sticking of the valve stem in the valve guide. The powder metal blend should have superior properties of abrasive and adhesive wear resistance, scuffing resistance, and the ability to run against various types of valve stem materials and valve stem coatings including but not limited to chrome plated and nitrided valve stems.

BRIEF SUMMARY OF THE INVENTION

Accordingly, an object of the present invention is to provide an improved powder metal blend useful for making an engine component.

Another object of the present invention is to provide an improved powder metal blend for making a powder metal valve guide.

Still another object of the present invention is to provide an improved powder metal valve guide particularly suited for operation in an oil starved environment.

Still another object of the present invention is to provide an improved powder metal valve guide with superior thermal conductivity to function as a better heat sink.

Still another object of the present invention is to provide an improved powder metal valve guide which has superior properties of abrasive and adhesive wear resistance, scuffing resistance, and the ability to run against various valve stem materials and valve stem coatings.

Still a further object of the present invention is to provide a powder metal valve guide that prevents valve stem and valve guide from seizure where there is little or no lubricant at the valve stem/valve guide interface.

The above and other objects of the present invention are accomplished with an improved powder metal blend suited for operation in a severe engine environment. The present invention comprises an improved powder metal blend having a chemical composition on a weight percent basis comprising: copper in an amount ranging from about 2 to about 10 percent; a solid lubricant in an amount ranging from about 0.5 to about 5.0 percent; graphite in an amount ranging from about 1.0 to about 3.0 percent; bronze in an amount ranging from about 1.0 to about 8.0 percent; iron and/or copper phosphorus in an amount ranging from about 0.2 to about 1.5 percent; a fugitive lubricant in an amount ranging from about 0.3 to about 1.0 percent; and the balance being a low alloy steel powder containing manganese in an amount ranging from about 0.3 to about 1.0 percent.

The various features of novelty which characterize the invention are pointed out with particularity in the claims annexed to and forming a part of this disclosure. For a better understanding of the invention, its operating advantages and specific objects attained by its uses, reference is made to the accompanying examples, drawings, and descriptive matter in which a preferred embodiment of the invention is illustrated.

DETAILED DESCRIPTION OF THE INVENTION

The present invention resides in a new and improved powder metal blend that is particularly suited for an engine component like a valve guide for an internal combustion engine. It should be understood that the powder metal blend of the instant invention may be used for manufacturing any vehicle part and is not to be limited to simply a valve guide. In the specification, unless otherwise specified, all temperatures are in degrees Celsius (° C.), and all percentages (%) are on a weight percent basis.

Powder metallurgy processes can offer a cost-effective, near-net shape production yet allow versatility in material selection and post sintering treatments. The novel material blend of the present invention offers superior properties of abrasive and adhesive wear resistance, scuffing resistance, and can run against various types of valve stems and stem coatings including chrome plated and nitrided valve stems.

The powder metal blend in accordance with the present invention is applicable as engine components in leaded and unleaded gasoline, diesel and natural gas engines in both light and heavy duty applications. Also, the powder part produced in accordance with the present invention has superior machinability and can be employed as an intake or an exhaust valve guide.

Figure 1:
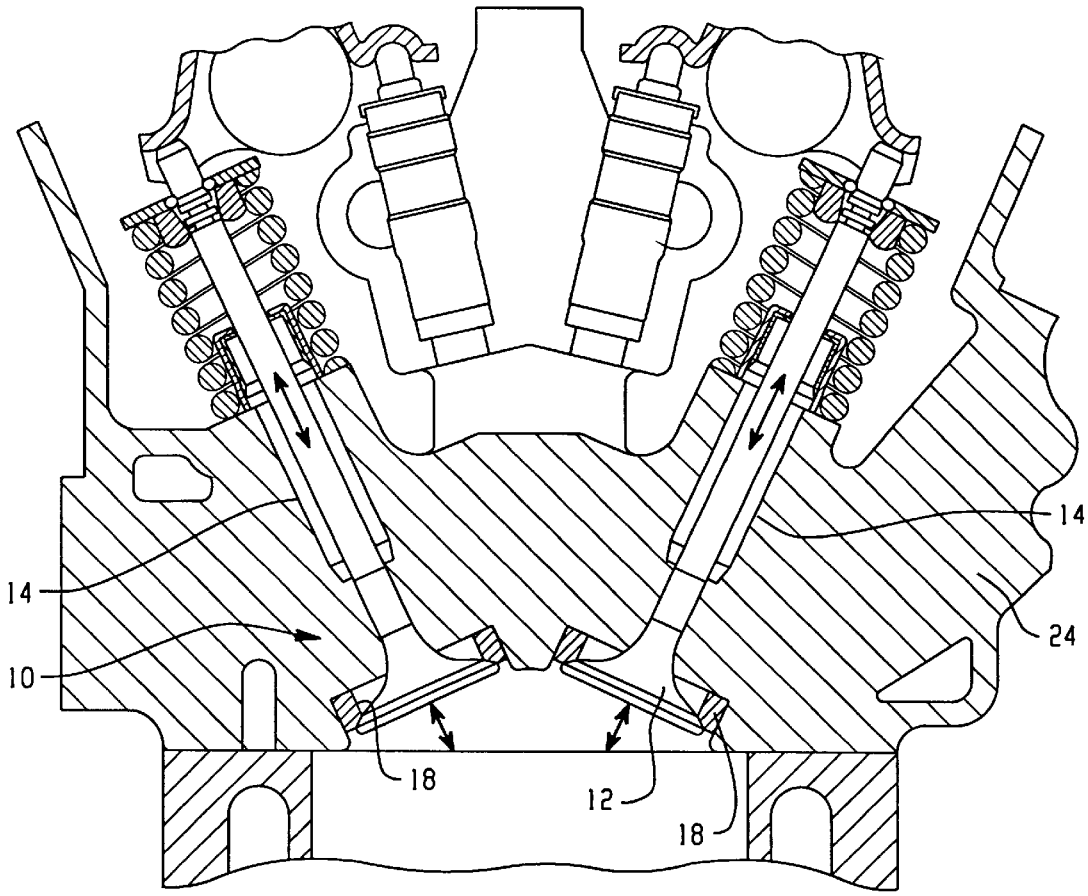
FIG. 1 is a cross sectional view illustrating a valve assembly and its associated environment.
Figure 2:
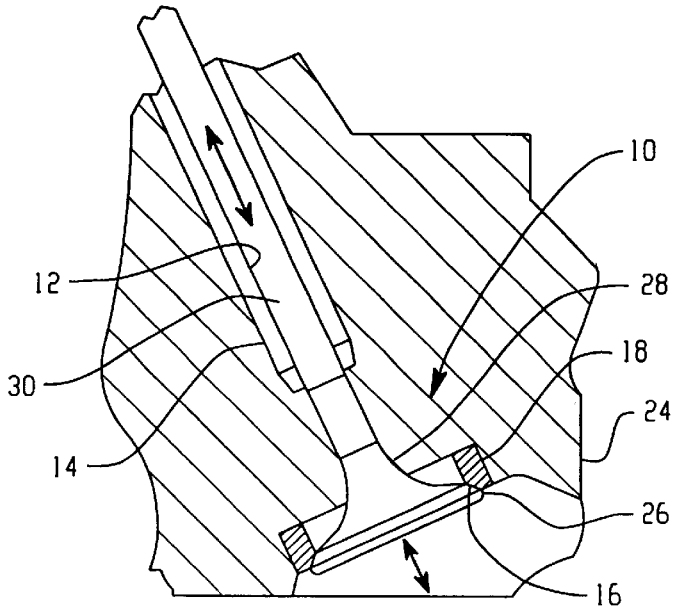
FIG. 2 is a cross-sectional view illustrating a valve assembly in more detail.

In order to better understand the application of the present invention to engine components, reference is made to FIGS. 1 and 2 where there is illustrated a valve assembly generally designated 10 for use in an engine. Valve assembly 10 includes a plurality of valves 12 each reciprocatingly received within the internal bore of a valve guide 14. The valve guide 14 is a tubular structure which is inserted into the cylinder head 24. Valve 12 includes a valve seat face 16 interposed between the head 26 and the fillet 28 of the valve 12. Valve stem 30 is located normally upwardly of the fillet 28 and usually is received within the valve guide 14. A valve seat insert 18 is normally mounted within the cylinder head 24 of the engine. The construction of these engine components are devices well known to those in this art. The present invention is not intended to be limited to any specific structure since modifications and alternative structures or designs are provided by various manufacturers. These valve assembly drawings are being provided for illustrative purposes only to facilitate a better understanding of the present invention.

The powder metal blend of the present invention comprises a mixture of copper, a solid lubricant, graphite, bronze, copper phosphorus, a fugitive lubricant, and the balance being a low alloy steel powder containing manganese. The powder metal blend in accordance with the present invention comprises a mixture of copper in an amount ranging from about 2 to about 10 percent, a solid lubricant in an amount ranging from about 0.5 to about 5 percent, graphite in an amount ranging from about 1 to about 3 percent, bronze in an amount ranging from about 1 to about 8 percent, copper and/or iron phosphorus in an amount ranging from about 0.2 to about 1.5 percent, a fugitive lubricant in an amount ranging from about 0.3 to about 1.0 percent, and the balance being a low alloy steel powder containing manganese in an amount ranging from about 0.3 percent to about 1.0 percent.

More preferably, the metal powder blend comprises a mixture of about 5 percent copper (Cu), about 2 percent solid lubricant, about 2 percent graphite, about 2 percent bronze, about 1.0 percent copper phosphorus, about 0.6 percent fugitive lubricant, and the balance being the low alloy steel powder containing preferably about 0.6 percent manganese (Mn).

The alloying levels of the powder metal blend in accordance with the present invention are such as to enhance hard phase and solid lubricity for wear resistance especially at high temperature applications under an environment devoid or nearly devoid of oil.

The addition of elemental copper yields solid solution strengthening and improves wear resistance. The free copper also improves machinability. The copper employed herein is meant to include but is not limited to any copper containing powder such as particles of substantially pure copper, particles of copper in an admixture with alloying elements, and/or other fortifying elements, and/or particles of pre-alloy copper.

The solid lubricant provides resistance to adhesion and enhances machinability. Suitable solid lubricants include but are not limited to powdered hydrated magnesium silicate (commonly referred to as talc), molybdenum disulfide ($MoS_2$), calcium fluoride ($CaF_2$), boron nitride (BN), tungsten disulfide ($Ws_2$), graphite, a silicate lubricant, a sulfide lubricant, a fluoride lubricant, a telluride lubricant, and mica. Of course, any conventional solid lubricant may be used with the mixture of the present invention, including but not limited to any other disulfide or fluoride type solid lubricant.

In the powder metal blend of the present invention, the graphite is employed to provide matrix strength, hard phase and solid lubricity which results in improved wear resistance and machinability. A portion of the graphite goes into solution and becomes primary carbide and eutectic carbide in the pearlite microstructure. The remaining graphite becomes solid lubricant. If there is more than about 2.0% free graphite in the premix, compressibility and green strength are lost. The term "free graphite" as used herein is meant to refer to the remaining graphite, that is, the graphite that does not go into solution. One suitable source for graphite powder is Southwestern 1651 grade, which is a product of Southwestern Industries Incorporated.

The bronze is added to create a bronze phase which offers solid lubricity and anti-scuffing properties. The bronze powder is preferably a typical 301 grade 90 percent copper and 10 percent tin, commonly referred to as a 90-10 bronze with a typical particle size of approximately 80 mesh. This is commercially available from any non-ferrous powder vendor, for example, AcuPowder International LLC.

The copper phosphorus provides pore rounding, matrix strength, and is a sintering aid. Preferably, the copper phosphorus is a pre-alloyed powder with about 8 percent phosphorus and the balance being copper. A commercial source for the copper phosphorus is AcuPowder International LLC.

The fugitive lubricant is a powdered lubricant, and is known in the art as "temporary" or "fugitive" since it burns off or pyrolyzes during the sintering step. Suitable lubricants include but are not limited to conventional waxy or fatty material such as stearates, stearamides, lithium stearate, zinc stearates, waxes, or commercially available but proprietary ethylene stearamide compositions or mold lubricants which volatilize upon sintering. The preferred fugitive lubricant is Acrawax C which is available from Glyco Chemical Company. Acrawax C helps to prevent galling of tools during compaction.

A suitable low alloy steel powder for the present invention is commercially available as MP37R from Domfer or 300 MA from Kobelco or A1000 from Hoeganaes or ASC 100.29 from North American Hoeganaes.

The powder metal blend or mixture according to the present invention is thoroughly mixed for a sufficient time to achieve a homogeneous mixture. The mixture is blended for about thirty minutes to about two hours, and preferably for about 1 hour to result in a homogeneous mixture. Any suitable mixing means, for example, a ball mixer, may be employed.

The mixture is then compacted at conventional compacting pressures of about 40 tons per square inch (TSI) to about 60 tons per square inch with a preferred pressure of about 50 TSI. In the metric system, this is about 608 to about 911 MPa, or preferably about 760 MPa. The compacting pressure should be adequate to press and form green compacts to a near net shape, or even a net shape, of a desired green density ranging from about 6.2 g/cm$^3$ to about 7.2 g/cm$^3$, and preferably to about 6.5 g/cm$^3$. Compaction is done generally with a die of a desired shape. Ordinarily, a pressure lower than about 35 TSI is hardly used, and pressures above about 65 TSI, while useful, may be prohibitively expensive. The compaction can be performed either uniaxial or isostactic.

The green compact is then sintered in a sintering furnace using conventional sintering temperatures which range from about 1000° C. to about 1150° C., and preferably at a temperature of about 1020° C. A higher sintering temperature may alternately be employed ranging from about 1250° C. to about 1350° C., and preferably about 1300° C. for about 20 minutes to about 1 hour or preferably at about 30 minutes in a reducing atmosphere of a gaseous mixture of nitrogen ($N_2$) and hydrogen ($H_2$). Sintering is a bonding of adjacent surfaces in the compact by heating the compact below the liquidus temperature of the majority of the ingredients in the compact. Sintering is performed at a temperature of approximately 1100° C. for a time period sufficient to effect diffusion bonding of the powder particles at their point of contact, and form an integrally sintered mass. Sintering is preferably done in a reducing atmosphere such as the nitrogen and hydrogen mixture or a dry associated ammonia having a dew point on the order of about −40° C. Sintering may also be done with an inert gas like argon, or in a vacuum.

The powder metal engine component manufactured in the above manner has a chemical composition on a weight percent basis that comprises about 1.5% to about 3.0% C; about 4.0% to about 10.0% Cu; up to about 0.5% Mg; up to about 1.2% Mn; up to about 0.8% P; up to about 0.6% S; up to about 0.8% Sn; and the balance being substantially Fe. Of the total carbon content, about 1.0% to about 1.8% of the carbon content is combined carbon. The term "combined carbon" as employed herein is meant to refer to carbon that is tied up or bonded with other elements, for example, in the form of carbides. Total carbon includes carbon in the combined form as well as elemental carbon, e.g., pure graphite form.

Advantageously, the resultant product can be used in either the assintered condition and/or a heat-treated condition as well as an oil impregnated condition. Suitable heat treating conditions include but are not limited to nitriding, carburizing, carbonitriding, or steam treating the compacted powder metal component. The resultant product may be copper infiltrated to improve thermal conductivity. An alternate embodiment will be described in greater detail herein with this feature.

In forming a valve guide, the material may be coined from the ends in a manner known in this art. The process is to form the ends which serves two purposes: straightening of the inner diameter (ID) of the bore to maintain the concentricity, and additional densification of the wear surface to further enhance the anti-scuffing properties. The valve guide material optionally may be impregnated with a high temperature oil to operate under a thin film or boundary lubrication regime. The oil fills in the pores in the powder metal valve guide and serves as reservoirs to provide continuous lubrication during application and to improve machinability during manufacturing. Because the amount of oil that can be impregnated is limited, one cannot rely solely on the impregnated oil for wear resistance.

In an alternate embodiment of the present invention, the hot end of the valve guide is copper infiltrated, after sintering, up to about one-third of the total length of the valve guide. This area is sufficient to effectively transfer heat away from the valve. The "hot end" of the valve guide is that end which is positioned in the cylinder head closest to the valve head. This location is closest to the combustion chamber. Optionally, the inner diameter of the bore through the valve guide may be semi-finished (a step well-known in this art) and dilute sulfuric acid eluted therethrough. The inner diameter of the bore through the valve guide is then nitrided, finished, and oil impregnated. The steps of copper infiltrating up to about one third the total length of the valve guide, nitriding the inner diameter of the bore through the valve guide, and optionally eluting dilute sulfuric acid through the inner diameter prior to the finishing step may be employed with a variety of powder metal blends other than the improved powder metal blend described herein to improve the thermal conductivity of the valve guide. The product and method of the alternate embodiment in accordance with the present invention is particularly suited for hollow valve stems, or sodium or potassium or other liquid cooled valve stems which can aggravate valve stem/valve guide sticking, scuffing, or wear due to improper heat transfer. A preferred valve guide manufactured according to the alternate embodiment of the present invention has a chemical composition comprising on a weight percent basis of about 0.5 to about 2.0 percent carbon; about 0.5 to about 1.0 percent manganese; less than or equal to about 0.5 percent silicon; less than or equal to about 5 percent solid lubricant; about 7 to about 20 percent copper (after infiltration); and the balance being iron.

A valve guide manufactured with the preferred powder metal blend of the present invention was evaluated with a rig test device described and shown in U.S. Pat. No. 5,271,823 which is assigned to the assignee of the present invention, and hereby incorporated by reference. The rig test allows for testing the wear as well as seizure characteristics of engine valve stems and guides. Three valve guides were tested: a valve guide made from a commercially available material designated EMS 543, a valve guide made from EMS 543 with a high temperature oil impregnation (designated EMS 543 HTO), and a valve guide made from the improved powder metal blend according to the present invention which was designated EXP 1439. EMS 543 has a chemical composition of from about 0.5 to about 0.9 percent carbon (C); about 0.5 to about 1.0 manganese (Mn); about 0.15 to about 0.35 sulfur (S); about 3.5 to about 5.5 copper (Cu); about 0.3 to about 0.6 magnesium (Mg) and the balance being iron and solid lubricant.

Figure 3:
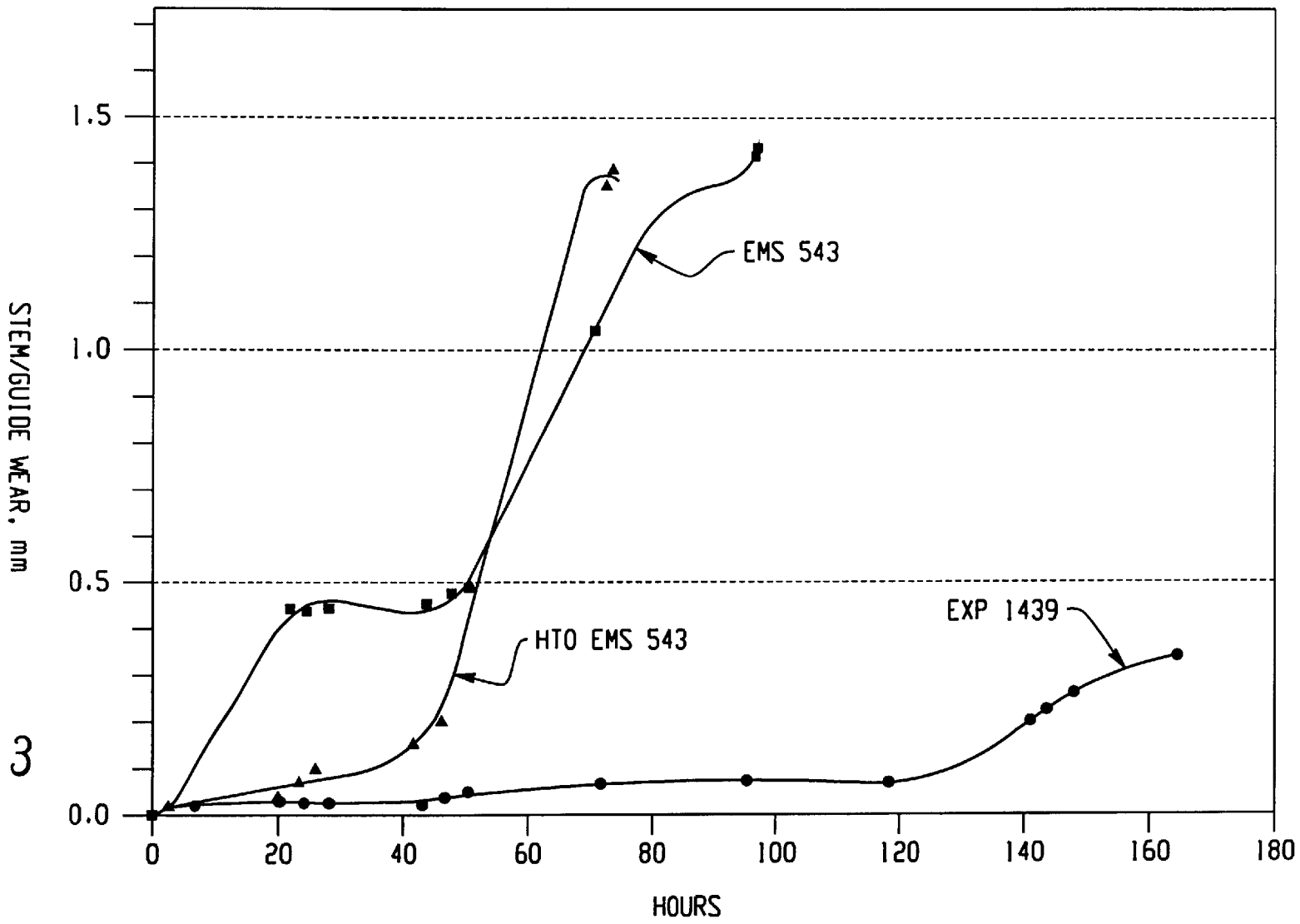
FIG. 3 is a graph illustrating material and cycle effect on stem/guide wear.

The valve stem and valve guide temperatures for the rig test were set at approximately 204° C. with actuations at 10 Hz (for simulation of valve movement). While oil impregnation appears to provide improved results initially, after about twenty hours or so, the oil impregnated valve guide begins to exhibit wear. After about 50 hours, the wear for EMS 543 HTO appears similar to that of the EMS 543 valve guide. The valve guide made with the powder metal blend of the instant invention results in significant wear reduction compared to EMS 543 as seen in FIG. 3. After about 20 hours the EMS 543 shows significant amount of wear, 0.42 mm as compared to 0.02 mm for the EXP 1439 (present invention). All tests were performed with pre-lube and without adding additional oil during testing.

Figure 4:
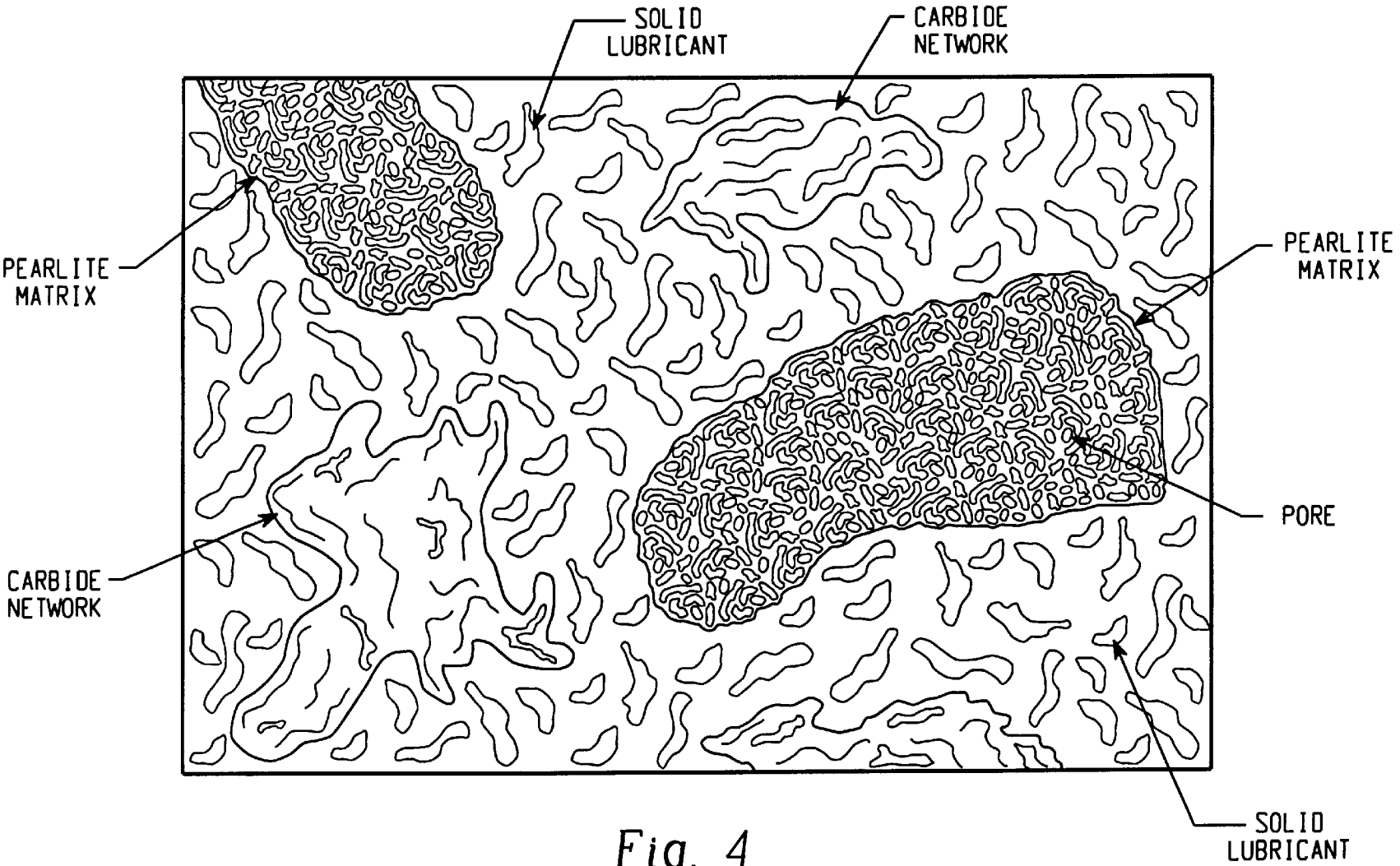
FIG. 4 is an illustration of the microstructure of a powder metal valve made in accordance with the present invention.

FIG. 4 is an illustration of the microstructure of a powder metal valve guide in accordance with the present invention. A valve guide with this microstructure exhibits optimum wear resistance with acceptable machinability. The microstructure matrix shows a maximum amount of pearlite which provides good strength and hardness. The ferrite amount compromises machinability and wear characteristics. In the present invention, the ferrite amount is minimized. The network of carbides maximizes the wear resistance. The combination of various solid lubricants including but not limited to graphite, talc, manganese sulfide, molybdenum disulfide, and calcium fluoride optimize the machinability and wear characteristics. The pores in the microstructure provide locations for copper infiltration and oil impregnation to improve machinability, wear resistance, and thermal conductivity when infiltrated with copper.

While specific embodiments of the present invention have been shown and described in detail to illustrate the application of the principles of the invention, it will be understood that the invention may be embodied otherwise without departing from such principles.

We claim:

1. A powder metal blend for making a powder metal part, comprising on a weight percent basis:

about 2.0 to about 10.0 percent Cu;

about 0.5 to about 5.0 percent solid lubricant;

about 1.0 to about 3.0 percent graphite, wherein less than or equal to about 2.0% of the graphite comprises free graphite;

about 1.0 to about 8.0 percent bronze;

about 0.2 to about 1.5 percent a member selected from the group consisting of copper phosphorus and iron phosphorus;

about 0.3 to about 1.0 percent fugitive lubricant; and a balance being a low alloy steel powder containing about 0.3 to about 1.0 percent Mn.

2. The powder metal blend as recited in claim 1, wherein said solid lubricant is a member selected from the group consisting of talc, $MOS_2$, $CaF_2$, $WS_2$, MnS, graphite, a silicate lubricant, a sulfide lubricant, a fluoride lubricant, a telluride lubricant, and mica.

3. The powder metal blend as recited in claim 1, wherein said fugitive lubricant is a member selected from the group consisting of zinc stearate, an ethylene stearamide mold lubricant, Acrawax C, stearates, stearamides, lithium stearate, and a synthetic wax lubricant.

4. The powder metal blend as recited in claim 1, wherein said blend comprises on a weight percent basis:

about 5.0% Cu;

about 2.0% solid lubricant;

about 2.0% graphite;

about 5.0% bronze;

about 1.0% a member selected from the group consisting of copper phosphorus and iron phosphorus;

about 0.6% fugitive lubricant; and the balance being a low alloy steel powder containing about 0.6% Mn.

5. A powder metal part manufactured from the powder metal blend of claim 1.

6. The powder metal part as recited in claim 5, wherein said powder metal blend is compacted to a minimum density of about 6.2 g/cm$^3$.

7. The powder metal part as recited in claim 6, wherein said density is about 6.4 g/cm$^3$.

8. The powder metal part as recited in claim 6, wherein said powder metal part comprises a valve guide.

9. A powder metal engine component having a chemical composition on a weight percent basis, comprising:

about 1.5% to about 3.0% C, wherein about 1.0% to about 1.8% of the carbon content comprises combined carbon in the form of carbides;

about 4.0% to about 10.0% Cu;

up to about 0.5% Mg;

up to about 1.2% Mn;

up to about 0.8% P;

up to about 0.6% S;

up to about 0.8% Sn; and the balance substantially being Fe.

10. A powder metal engine component as recited in claim 9, wherein said component is compacted to a minimum density of about 6.2 g/cm$^3$.

11. A powder metal engine component as recited in claim 10, wherein said density is about 6.4 g/cm$^3$.

12. A powder metal engine component as recited in claim 9, wherein said powder metal engine component comprises a valve guide.

13. A powder metal engine component as recited in claim 12, wherein said valve guide comprises an oil impregnated valve guide.

14. A powder metal blend for making a powder metal part, comprising on a weight percent basis:

about 2.0 to about 10.0 percent Cu;

about 0.5 to about 5.0 percent solid lubricant;

about 1.0 to about 3.0 percent graphite;

about 1.0 to about 8.0 percent bronze;

about 0.2 to about 1.5 percent copper phosphorus;

about 0.3 to about 1.0 percent fugitive lubricant; and a balance being a low alloy steel powder containing about 0.3 to about 1.0 percent Mn.

15. The powder metal blend as recited in claim 14, wherein said solid lubricant is a member selected from the group consisting of talc, $MoS_2$, $CaF_2$, $WS_2$, MnS, graphite, a silicate lubricant, a sulfide lubricant, a fluoride lubricant, a telluride lubricant, and mica.

16. The powder metal blend as recited in claim 14, wherein said fugitive lubricant is a member selected from the group consisting of zinc stearate, an ethylene stearamide mold lubricant, Acrawax C, stearates, stearamides, lithium stearate, and a synthetic wax lubricant.

17. The powder metal blend as recited in claim 14, wherein said blend comprises on a weight percent basis:

about 5.0% Cu;

about 2.0% solid lubricant;

about 2.0% graphite;

about 5.0% bronze;

about 1.0% copper phosphorus;

about 0.6% fugitive lubricant; and the balance being a low alloy steel powder containing about 0.6% Mn.

18. A powder metal part manufactured from the powder metal blend of claim 15.

19. The powder metal part as recited in claim 18, wherein said powder metal blend is compacted to a minimum density of about 6.2 g/cm$^3$.

* * * * *